US005544806A

United States Patent [19]

Anderson et al.

[11] Patent Number: 5,544,806

[45] Date of Patent: Aug. 13, 1996

[54] BOX FOR CARRYING AND PROTECTING A PAINTING

[76] Inventors: Thomas J. Anderson, 1325 Greenbrook Dr.; Hugh C. Walker, 120 Raven Ct., both of Danville, Calif. 94526

[21] Appl. No.: 517,261

[22] Filed: Aug. 22, 1995

[51] Int. Cl.[6] ..... B65D 5/42; B65D 81/02

[52] U.S. Cl. ..... 229/178; 206/453; 206/454; 206/586; 229/191

[58] Field of Search ..... 229/120.32, 178, 229/182.1, 191, 906, 918; 206/453, 454, 476, 485, 564, 565, 586, 588; 220/441

[56] References Cited

U.S. PATENT DOCUMENTS

| | | | |
|---|---|---|---|
| 295,030 | 3/1884 | Marot . | |
| 728,450 | 5/1903 | Everett . | |
| 941,212 | 11/1909 | Tolman . | |
| 1,168,565 | 1/1916 | Rosenwald . | |
| 2,709,032 | 5/1955 | Ritchie | 229/191 |
| 2,732,121 | 1/1956 | McGovern . | |
| 2,852,178 | 9/1958 | Bolding | 229/191 |
| 2,861,681 | 11/1958 | Lane | 206/453 |
| 3,184,136 | 5/1965 | Forbes, Jr. | 229/918 |
| 3,211,282 | 10/1965 | Hennessey | 220/441 |
| 3,281,031 | 10/1966 | Shapiro . | |
| 3,339,722 | 9/1967 | Antwerpen | 206/453 |
| 3,362,609 | 1/1968 | Freedy | 206/453 |
| 3,516,538 | 6/1970 | Antwerpen | 206/453 |
| 4,881,771 | 11/1989 | Sullivan . | |
| 4,892,193 | 1/1990 | Thomas | 206/454 |
| 5,002,221 | 3/1991 | Ragan . | |
| 5,076,432 | 12/1991 | Wolf et al. | 206/454 |
| 5,145,108 | 9/1992 | Pinckney et al. | 229/117.26 |
| 5,326,147 | 7/1994 | Watson . | |
| 5,402,930 | 4/1995 | Storms et al. . | |

FOREIGN PATENT DOCUMENTS

| | | | |
|---|---|---|---|
| 79762 | 2/1952 | Norway | 220/441 |

*Primary Examiner*—Gary E. Elkins
*Attorney, Agent, or Firm*—Thomas R. Lampe

[57] ABSTRACT

A box for carrying and protecting a painting includes a primary panel and side and end panels connected to the primary panel and disposed orthogonally with respect to the primary panel. The panels are locked together to define a box interior for holding a painting. Pairs of engagement members located at the corners of the box project into the box interior and maintain the painting spaced from the primary panel and out of engagement with the primary panel. The box is formed from a unitary blank.

11 Claims, 3 Drawing Sheets

BOX FOR CARRYING AND PROTECTING A PAINTING

TECHNICAL FIELD

This invention relates to a box for carrying and protecting a painting and a blank of unitary construction for forming the box.

BACKGROUND ART

Art students and others encounter problems when transporting paintings, particularly when the paintings have not completely dried. Typically, such paintings are artists' media on canvas stretched on a frame, usually rectangular, or on a sheet or board. Wet paintings can be and often are smeared or marred during transport and even during storage. Also, dust and other foreign matter can adhere to an unprotected wet painting. .

Carriers for paintings have been devised. However, such prior art arrangements are typically relatively expensive and complicated. The following United States patents are believed to be representative of the state of the prior art in the field of painting carriers: U.S. Pat. No. 4,881,771, issued Nov. 21, 1989, U.S. Pat. No. 5,326,147, issued Jul. 5, 1994, U.S. Pat. No. 941,212, issued Nov. 23, 1909, U.S. Pat. No. 728,450, issued May 19, 1903, and U.S. Pat. No. 3,281,031, issued Oct. 25, 1996.

The following United States patents are directed to general box constructions not intended or suitable for the transport of wet paintings: U.S. Pat. No. 5,002,221, issued Mar. 26, 1991, U.S. Pat. No. 5,402,930, issued Apr. 4, 1995, U.S. Pat. No. 2,732,121, issued Jan. 24, 1956, U.S. Pat. No. 1,168,565, issued Jan. 18, 1916, and U.S. Pat. No. 295,030, issued Mar. 11, 1884.

DISCLOSURE OF INVENTION

The present invention relates to a box of relatively simple and inexpensive construction for carrying and protecting a painting having corners. The box includes a primary panel having two opposed side edges and two opposed end edges extending between the side edges.

Side panels extend along the two opposed side edges, the side panels being spaced from one another and disposed orthogonally with respect to the primary panel.

End panels extend along the two opposed end edges, the end panels being spaced from one another and disposed orthogonally with respect to both the primary panel and the side panels. Locking means locks together the side panels and the end panels and maintains the side panels and the end panels orthogonally disposed relative to the primary panel.

The box also includes painting engagement means for engaging opposed sides of a painting positioned between the side and end panels at corners of the painting to maintain the painting spaced from the primary panel and out of engagement with the primary panel.

The painting engagement means comprises a plurality of pairs of spaced painting engagement members projecting inwardly of the end panels and side panels and adjacent to the primary panel. Each pair of painting engagement members defines spaces for accommodating a corner of a painting positioned in the box with the painting engagement members of each pair thereof frictionally engageable with both sides of the painting at a corner of the painting.

The present invention also encompasses a paperboard blank of integral construction for forming the box.

Other features, advantages, and objects of the present invention will become apparent with reference to the following description and accompanying drawings.

BEST MODE FOR CARRYING OUT THE INVENTION

As stated above, the box of the present invention is for the purpose of carrying and protecting a painting having corners. The term "painting" as used herein encompasses any art work having artists' media disposed on a side thereof.

Figure 1:
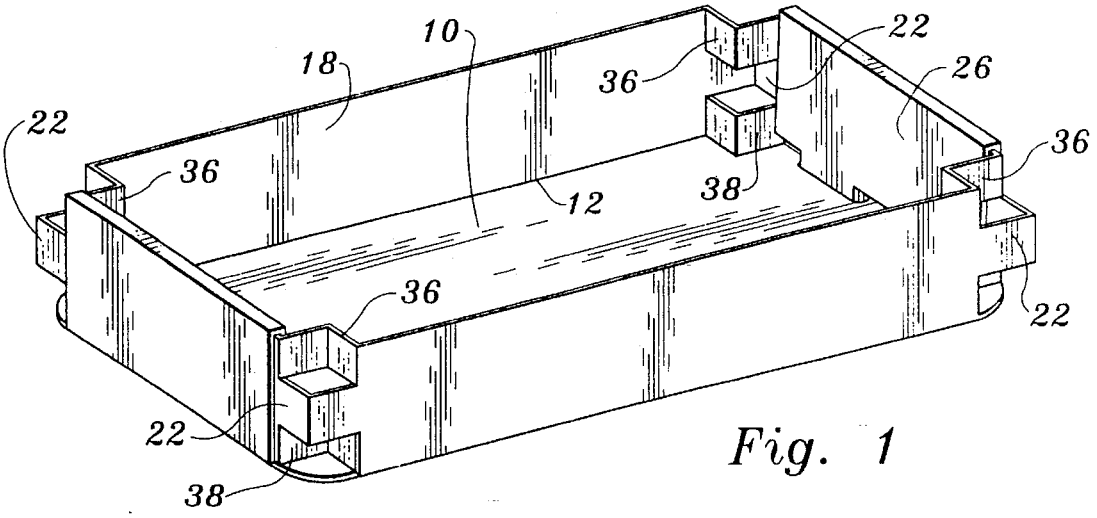
FIG. 1 is a perspective view of a box constructed in accordance with the teachings of the present invention.
Figure 2:
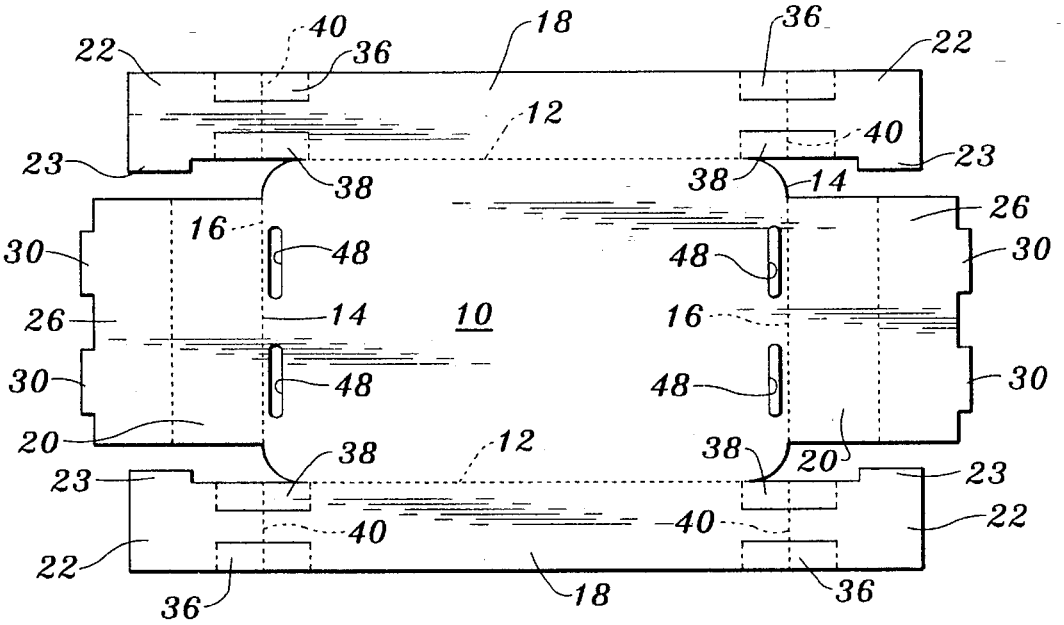
FIG. 2 is a top plan view of a unitary blank used to form the box.

FIG. 2 illustrates a unitary paperboard (preferably corrugated paperboard) blank utilized to construct the box of the present invention. The box itself is shown in assembled condition in FIG. 1.

The blank includes a primary panel 10 having two opposed side edges coincident with fold lines 12. The primary panel also has two opposed end edges 14 partially defined by fold lines 16.

Side panels 18 extend along the two opposed side edges of the primary panel, the side panels being of rectangular configuration, spaced from one another, and disposed orthogonally with respect to the primary panel when the box is assembled as will be described below.

End panels 20 extend along end edges 14 of the primary panel, the side panels being of rectangular configuration, spaced from one another, and disposed orthogonally with respect to the primary panel when the blank is assembled into the box shown in FIG. 1.

Foldably connected to opposed ends of the side panels 18 are first lock panels 22 having tabs 23 thereon.

Second lock panels 26 are foldably connected to end panels 20. Tab members 30 are integral with the second lock panels and project from the second lock panels, as shown.

The blank and box further include a pair of spaced painting engagement members 36, 38 located at the corners of the primary panel 10. The members 36, 38 are defined by fold lines and lines of cut formed in the blank, and more particularly in side panels 18 and first lock panels 22, as illustrated. Each of the members 36, 38 is comprised of two painting engagement panels interconnected by a fold line 40 extending the width of and separating the side panels and first lock panels.

Figure 3:
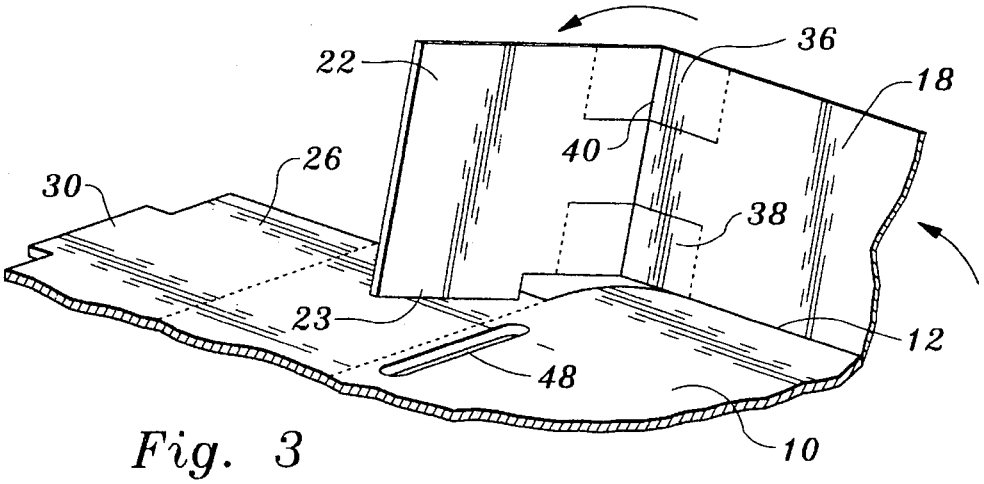
FIGS. 3, 4 and 5 are enlarged detail views of a corner segment of the blank showing sequential steps carried out when assembling the blank into the box.

Assembly of the box will now be described. First, as shown in FIG. 3, the side panels 18 are folded along fold line 12. The first lock panels 22 attached to the ends of the side panels 18 are folded inwardly as shown in FIG. 3 and as designated by the arrow in that figure. The tabs 23 are positioned into corresponding slots 48 formed in the primary panel.

Figure 4:
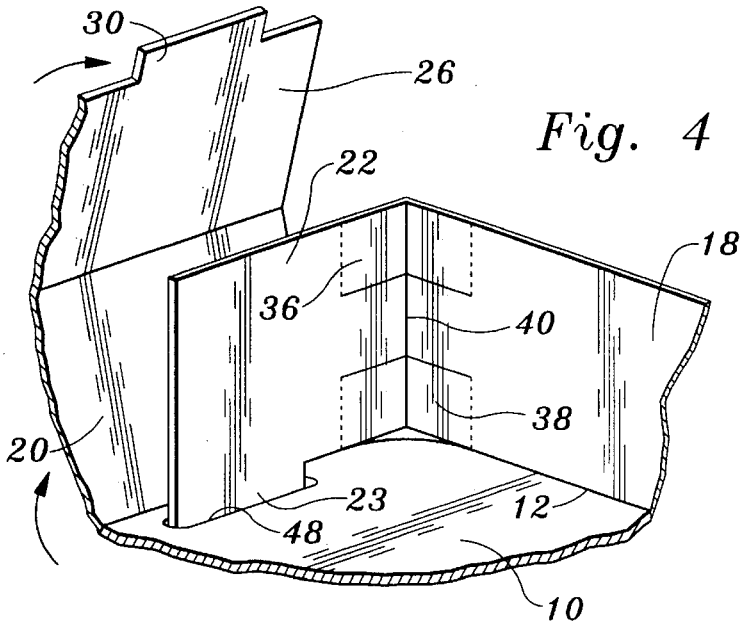

After the side panels 18 are at right angles to the primary panel and to the first lock panels 22, end panels 20 are folded (as illustrated with respect to one of the end panels in FIG. 4) until the end panel is substantially parallel to the associated first lock panel.

Figure 5:
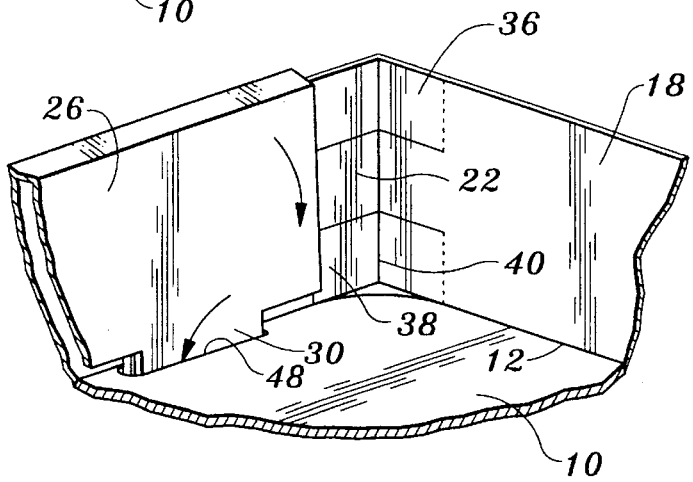

The second lock panel 26 is then folded to the position illustrated in FIG. 5 wherein the first lock panel is sandwiched between the end panel 20 and the second lock panel 26. The tab members 30 are then inserted into the corresponding slots 48 formed in the primary panel. This locks all of the folded panels together and securely in place. The side panels are spaced from one another and disposed orthogonally with respect to the primary panel. The end panels are spaced from one another and disposed orthogonally with respect to both the primary panel and the side panels.

Figure 6:
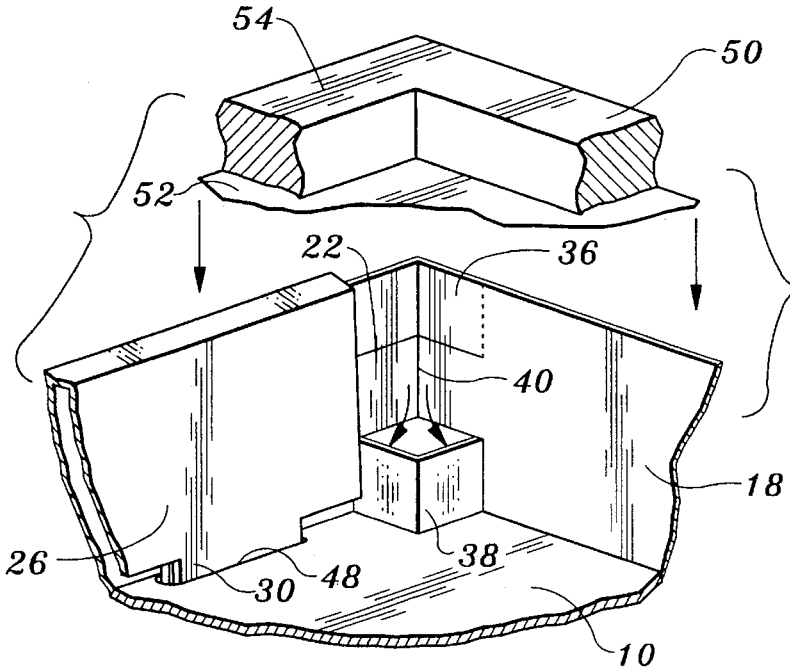
FIG. 6 is a sectional view of a segment of the assembled box in the condition assumed thereby just prior to placement of a painting in the box.

Now the user of the box manually pushes inwardly against painting engagement members 38 so that they project inwardly into the interior of the box (as shown, for example, in FIG. 6). Such manipulation takes place at all four corners of the box. To add strength and stability to painting engagement member 38, such member engages primary panel 10 as well as a side edge of its associated second lock panel 26.

When all four painting engagement members 38 have been moved inwardly to the position shown with respect to one of the members in FIG. 6 the box is in condition for receiving a painting 50. The illustrated painting includes a canvas 52 and rectangular frame 54. The painting 50 is positioned over the box with the artists' media directed downwardly toward the primary panel 10. The painting is then positioned on the four painting engagement members 38, the members 38 engaging only the corners of the painting and maintaining the painting spaced from the primary panel and out of engagement with the primary panel.

Figure 7:
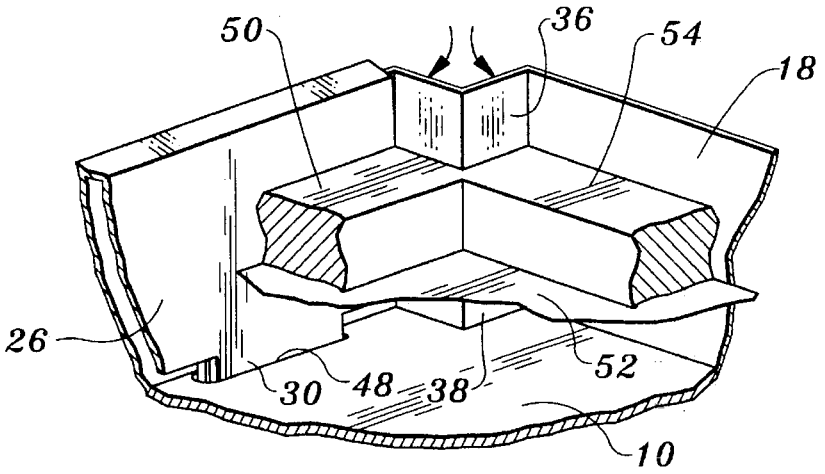
FIG. 7 is a view similar to FIG. 6 but illustrating a segment of the painting in place in the box and locked into position relative thereto.

Next, the painting engagement member 36 is pushed inwardly as shown by the arrows in FIG. 7 so that it is disposed for contact with the back side of the frame 54. Once all four painting engagement members 36 have been pushed inwardly, the painting is securely positioned within the box with the artists' media protected against harm. The painting may readily be removed from the box by manually manipulating the painting engagement members 36 outwardly.

Figure 8:
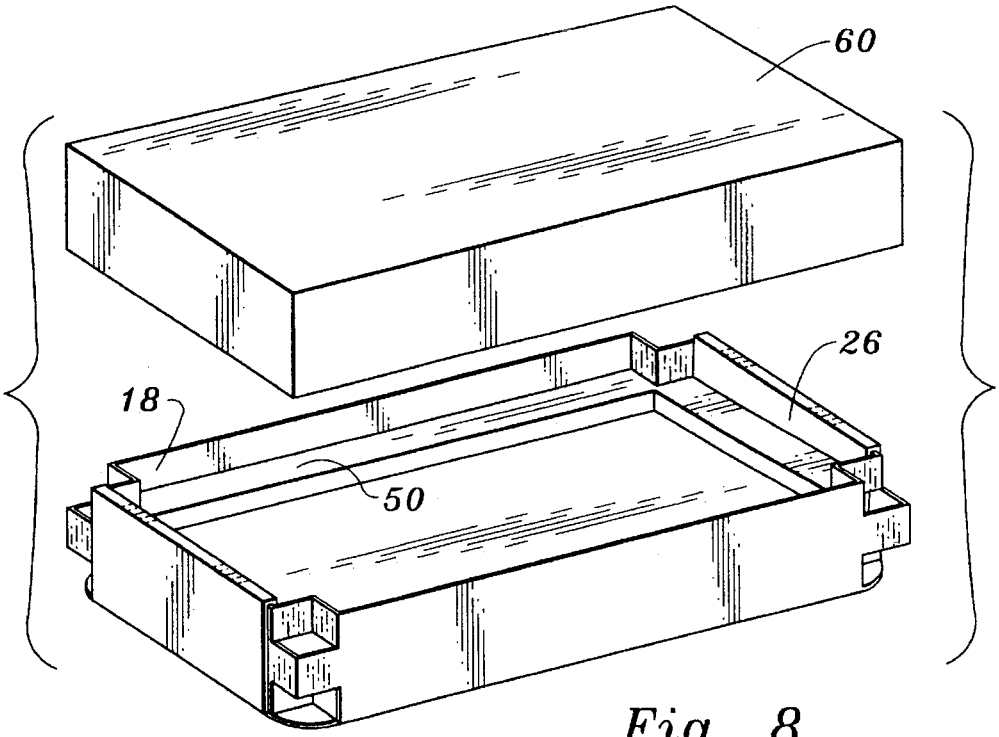
FIG. 8 illustrates the assembled box having a painting therein and a cover in position for placement over the box and painting.
Figure 9:
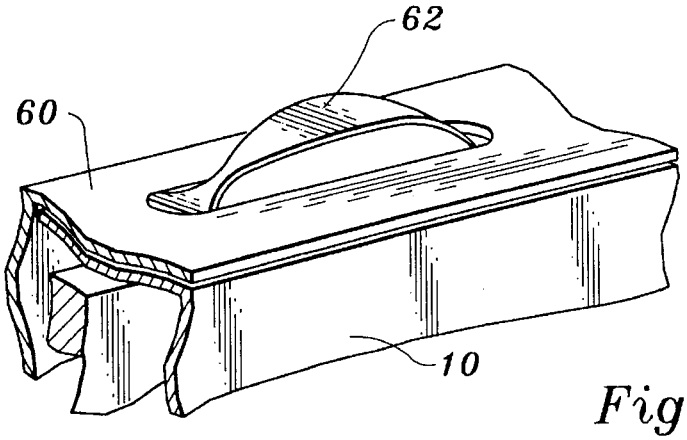
FIG. 9 is an enlarged, sectional, perspective view illustrating a handle that may be employed to facilitate carrying of the box.

If desired, a cover, such as that shown in FIG. 8 and designated by reference numeral 60, may completely enclose the interior of the box, although this is not normally necessary. In addition, a handle of any suitable type may be employed with the box to facilitate carrying thereof. This feature might be particularly useful for large paintings. FIG. 9 illustrates a handle 62 which may be of any suitable construction.

We claim:

1. A box for carrying and protecting a painting having corners, said box comprising, in combination:

a primary panel having two opposed side edges and two opposed end edges extending between said side edges;

side panels extending along said two opposed side edges, said side panels being spaced from one another and disposed orthogonally with respect to said primary panel;

end panels extending along said two opposed end edges, said end panels being spaced from one another and disposed orthogonally with respect to both said primary panel and said side panels;

locking means locking together said side panels and said end panels and maintaining said side panels and said end panels orthogonally disposed relative to said primary panel; and painting engagement means for engaging opposed sides of a painting positioned between said side and end panels at corners of the painting to maintain the painting spaced from said primary panel and out of engagement with said primary panel, said painting engagement means comprising a plurality of pairs of spaced painting engagement members projecting inwardly of said end panels and side panels and adjacent to said primary panel, each pair of painting engagement members defining a space for accommodating a corner of a painting positioned in said box with the painting engagement members of each pair thereof frictionally engageable with both sides of the painting at a corner of the painting, each said painting engagement member comprising two painting engagement panels interconnected at a fold line and disposed at an angle with respect to one another, and said painting engagement panels being at least partially defined by said side panels.

2. The box according to claim 1 wherein said pairs of painting engagement members are located for engagement with all corners of said painting.

3. The box according to claim 2 wherein one of the painting engagement members of each pair of painting engagement members is in engagement with said primary panel to strengthen and stabilize said one painting engagement member.

4. The box according to claim 1 wherein said locking means includes first lock panels foldably connected to opposed ends of said side panels, said painting engagement panels being defined by lines of cut in said side panels and said first lock panels.

5. The box according to claim 4 wherein said locking means additionally comprises second lock panels foldably connected to said end panels and extending parallel to said end panels, each said first lock panel being sandwiched between one of said end panels and an associated one of said second lock panels.

6. The box according to claim 5 wherein openings are formed in said primary panel, said locking means additionally comprising at least one tab member projecting from each of said second lock panels and positioned in one of said openings.

7. The box according to claim 6 wherein said locking means additionally comprises at least one tab projecting from each of said first lock panels and positioned in one of said openings.

8. The box according to claim 5 wherein said second lock panels have second lock panel side edges in engagement with said painting engagement members for stabilizing and strengthening said painting engagement members.

9. The box according to claim 1 formed of corrugated paperboard and of integral construction.

10. The box according to claim 1 in combination with a cover positioned over said primary panel.

11. The box according to claim 1 in combination with a carrier handle connected to one of said panels.

* * * * *